United States Patent [19]

Eck

[11] Patent Number: 4,856,302

[45] Date of Patent: Aug. 15, 1989

[54] BATCH WASHING MACHINE

[75] Inventor: Werner Eck, Herzogenaurach, Fed. Rep. of Germany

[73] Assignee: Kleindienst GmbH Firma, Augsburg, Fed. Rep. of Germany

[21] Appl. No.: 130,113

[22] PCT Filed: Feb. 26, 1987

[86] PCT No.: PCT/EP87/00114

§ 371 Date: Oct. 28, 1987

§ 102(e) Date: Oct. 28, 1987

[87] PCT Pub. No.: WO87/05345

PCT Pub. Date: Sep. 11, 1987

[30] Foreign Application Priority Data

Mar. 5, 1986 [DE] Fed. Rep. of Germany ..... 3607119

[51] Int. Cl.[4] ..... D06E 21/04

[52] U.S. Cl. ..... 68/27; 68/58; 68/142

[58] Field of Search ..... 134/27, 58, 139, 140, 134/142; 277/68, 69

[56] References Cited

U.S. PATENT DOCUMENTS

| | | | |
|---|---|---|---|
| 2,053,932 | 9/1936 | Zimarik | 68/58 U X |
| 2,426,455 | 8/1947 | Jorgenson | 68/58 X |
| 2,437,179 | 3/1948 | Wheeler | 68/58 X |
| 2,800,786 | 7/1957 | Schang | 68/58 |
| 2,865,188 | 12/1958 | Kling et al. | 68/58 X |
| 4,094,172 | 6/1978 | Arenot | 68/58 |
| 4,619,121 | 10/1986 | Mollerus | 68/58 X |

FOREIGN PATENT DOCUMENTS

| | | | |
|---|---|---|---|
| 1348690 | 12/1963 | France | 68/58 |

*Primary Examiner*—Frankie L. Stinson
*Attorney, Agent, or Firm*—Herbert Dubno

[57] ABSTRACT

The invention relates to a batch washing machine (1) with at least one rotatably supported and driven cylinder (2, 3), wherein several washing compartments are formed, through which the laundry is passed step by step. For this purpose, the cylinder (2) is supported by rollers (6, 7) at its two ends (4, 5) and is also driven at one or both support points. In the construction of a batch washing machine with a twin-shell cylinder, the outer cylinder (3) is stationary, while the inner cylinder (2) extends at both ends (4, 5) over the outer cylinder (3) and is supported and driven at this projection (23). Therefore, on the projection (23) a stepped annular flange (10) is fastened, which has an annular groove (11) for guiding the support rollers (6, 7) and immediately next to it a sprocket wheel (12) for the chain (9).

9 Claims, 3 Drawing Sheets

BATCH WASHING MACHINE

CROSS REFERENCE TO RELATED APPLICATIONS

This application is a national phase application of PCT/EP87/00114 filed 26 Feb. 1987 and based upon German National Application P No. 3607119.0 filed 5 Mar. 1986 under the International Convention.

The invention relates to a batch washing machine with with at least one rotatingly supported and driven cylinder in which several washing compartments are formed.

BACKGROUND OF THE INVENTION

From German patent document DE-OS No. 25 27 502 and the DE-OS No. 28 01 381, a batch washing machine with a twin shell washing drum is known, wherein the inner cylinder is suspended by several chains and is driven rotatingly. The batch washing machine is built as a continuous washing machine, wherein the inner cylinder is subdivided by partitions into several washing compartments, filled with different washing liquids and through which the laundry is passed through, step by step. In order to insure the transport of the laundry, in the inner cylinder spirally configured advancement ribs are provided, which at a corresponding rotating motion of the cylinder move the laundry over the partitions. The inner movable cylinder is surrounded by an outer fixed cylinder or only by a half-shell, a free space being thus created between the two, this space being subdivided into segments, corresponding to the washing compartments, wherein the various washing solutions are kept. The inner cylinder is perforated at least in its lower portion, so that the washing solutions can reach its interior spaces.

Batch washing machines with twin-shell washing drums have the best washing efficiency, however they create problems with the support system of the rotating inner cylinder. The chain has to be passed through the washing liquid, which impairs the lubrication of the chain and leads to a short life span of the chain. German patent document DE-OS No. 25 27 502 atmosphere solve this problem with a special sealing system, which however in practice has proven to have quite unsatisfactory results. Besides, the double function of the chain as a support- and a driving means leads to considerable constructive difficulties. The driven cylinder does not have a perfect rotation and due to displacements of the laundry in its inner space turns erratically. This, together with the various chain elongations in the row of chain drives leads to the danger of the inner and outer cylinder brushing against each other, impairing their operation. German patent document DE-OS No. 28 01 381 tries to solve this problem with a complicated driving technique with dynamic force balancing.

OBJECT OF THE INVENTION

It is therefore the object of the invention to provide a batch washing machine which can have a simpler and safer support- and driving system for the rotating cylinder.

SUMMARY OF THE INVENTION

The invention attains this object in that the cylinder is supported on rollers only at its both ends and also driven there.

The solution according to the invention can be used for all types of batch washing machines, whether their washing drums ar single- or twin shelled. This support system based on exclusively supporting the cylinder at its ends and with the drive in the immediate vicinity of the support point has the advantage that the rotation of the driven and suitably reinforced cylinder is safeguarded in the points where this is actually needed. At the cylinder ends namely feeding- and discharge devices for the laundry reach into the internal space of the cylinder, the cylinder being in an accurate alignment therewith.

In the case of a single-shell washing drum, the support- and drive means act directly upon the outside of the rotating cylinder. In the case of a twin-shell washing drum, according to the invention, the inner cylinder projects beyond the outer fixed cylinder by a certain stretch and is mounted and driven by rollers via this projection. The drive can be managed in both cases in any desired manner. Besides the aforementioned chain drive, a gear drive or a fractional drive is possible. In comparison to the known twin-shell washing drums, the chain has here only drive functions, which increases the safety and operational life of the chain drive.

The invention also makes possible a cost-efficient construction, since the annular flange according to the invention combines both guiding and driving functions.

For the sealing of the rotating inner cylinder with respect to the fixed outer cylinder in the projection area, a sealing system according to the invention is provided. Since the two cylinders are not supported against each other in the washing area, the sealing system according to the invention can also be used there for the absolutely perfect separation of the washing liquids. This is especially important for washing processes wherein color bleeding can occur when the washing solutions are mixed, which can lead to an undesired coloring of the laundry. The elasticity of the sealing system acts favorably in the washing area, since it balances the displacement of the inner cylinder with respect to the outer cylinder. For the seal at the cylinder end, a fresh water counterflow can be directed over the flooding chamber into the free space between the two cylinders, which prevents solid particles (sand, needles, etc) from reaching the sealing lip. The sealing system according to the invention has the special advantage for the batch washing machine of the invention that the two cylinders do not need to have in their end areas indentations for sealing purposes, but can have a continuously straight configuration. This has advantages for the mechanical stability of the machine and facilitates the construction of cost-efficient cylinders.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
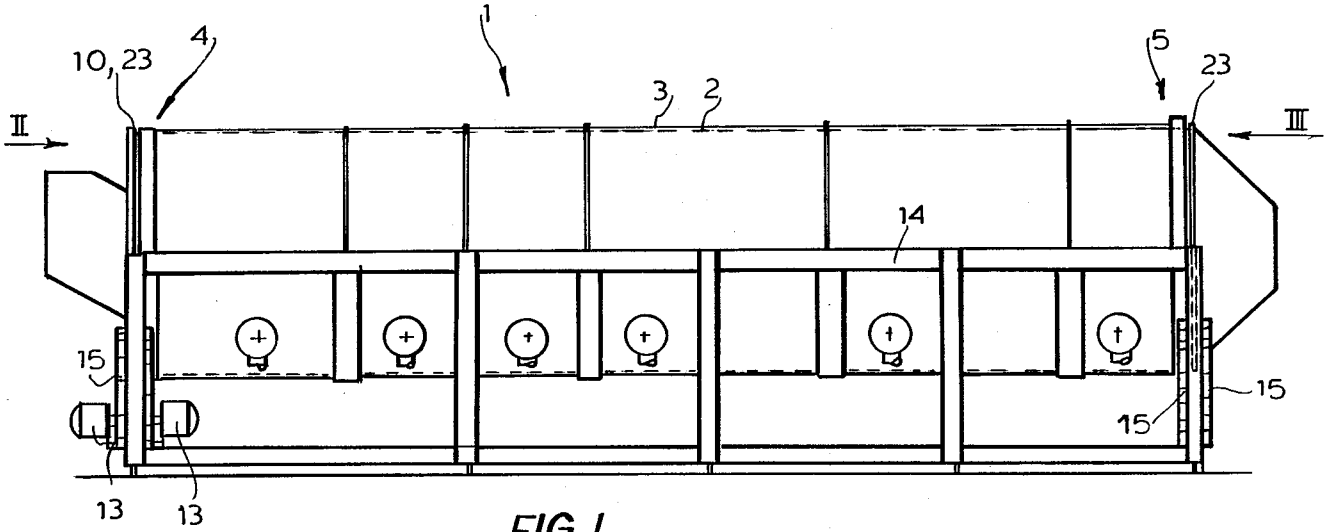
FIG. 1 is a side elevational view of a batch washing machine with a twin shell washing drum.

FIG. 1 shows a batch washing machine 1 cylinder 2 and an outer cylinder 3 immovably supported in a stand or base 14.

The interiors of the two cylinders 2, 3 is built in the washing area in a manner known per se, whereby partitions form washing compartments inside the inner cylinder 2 with different washing solutions in them. For the washing process, the inner cylinder 2 is moved back and forth, in a reversing motion. After the washing cycle is finished, the inner cylinder 2 is rotated through a greater angle, whereby the spirally configured advance ribs provided inside the cylinder function to push the laundry over the partitions, into the next washing compartment. After that, the next washing cycle is started with a reversing cylinder motion. The described details are not represented in the drawing.

The inner cylinder 2 is a self-supporting tube, which is supported only at the two ends 4, 5. An intermediate support system is not necessary even with longer cylinders 2, if the tube is correspondingly reinforced. At the ends 4, 5, the inner cylinder 2 extends over the outer cylinder 3 by a stretch (compare with FIG. 4). The support means and the drive means act upon this projection 23. At the two ends 4, 5, funnels or similar means are provided for the discharge of the laundry.

In the embodiment of FIG. 1, the inner cylinder 2 is driven only at one end 4. The drive can also be provided at the other end 5 or as a double drive on both ends 4, 5.

Figure 2:
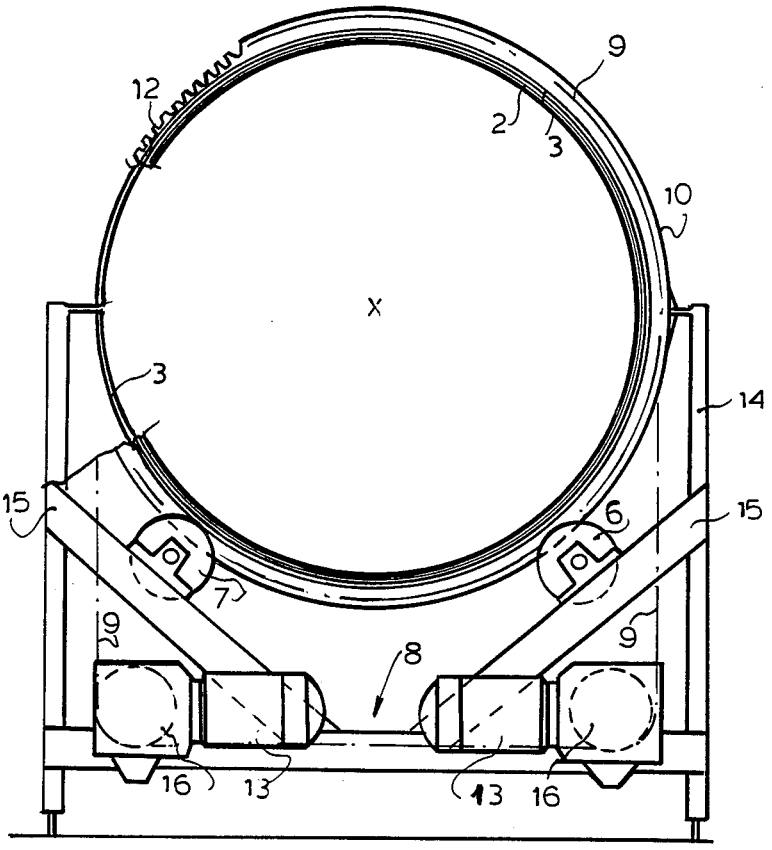
FIG. 2 is a front end view of the batch washing machine taken in the direction of arrow II in FIG. 1.
Figure 3:
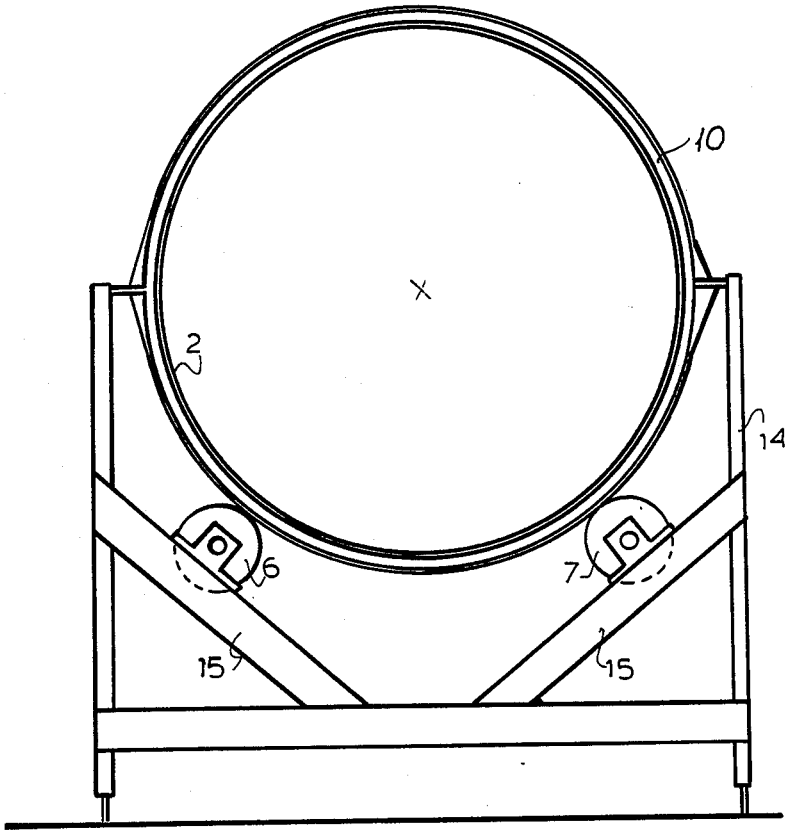
FIG. 3 is a rear end view of the batch washing machine taken in the direction of arrow III in FIG. 1.

The support system and the drive are in the immediate vicinity of each other in the batch washing machine 1. For this purpose, at the end 4 of the inner cylinder 2 a stepped annular flange 10 is fastened, which turns with the cylinder 2. According to FIG. 4, the annular flange 10 has an annular groove 11 and next to it a higher set sprocket 12. Support rollers 6, 7 engage into the annular groove 11, the rollers being mounted at the ends 4, 5 on supports 15 in the stand 14. In the illustrated embodiment, the rollers 6, 7 support the inner cylinder 2 only from underneath (compare FIGS. 2 and 3. In other embodiments, a greater number of support rollers can be provided, and can also be arranged all around the inner cylinder 2.

In the embodiment of FIG. 1 with a unilateral drive, the annular groove 11 is a radial and axial guide for the impact of the support rollers 6, 7. The annular flange 10 at the other end 5 is thereby a simple support ring without a sprocket 12 and without the axially-guiding annular groove 11. For the support rollers 6, 7 at the end 5 there is only a radial guidance, which allows for variations in the length of cylinder (2) due to heating, or the like.

For driving the inner cylinder 2, a chain drive 8 is provided which has an endlessly running chain 9, which engages with the sprocket 12 in the upper area of the cylinder. Four motors 13 are provided for the chain drive, these being electrical plug-in motors located at the base of the stand 14. The drive takes place via two chain sprockets 16 each being driven by two of the compactly built motors 13. The chain sprockets 16 are arranged in such a manner that the chain 7 is guided over the sprocket wheel 12 in a looping angle of 180° and in a straight line between the chain sprockets 16.

The cylinders 2, 3 are straight, mutually aligned tubes. This requires at the projection 23 an axial sealing of the free space 21 between the two cylinders 2, 3, which is filled with washing solution. The inner cylinder 2 is perforated only in the washing area and up to this sealing system, but not in the area of the projection 23. The sealing is effected by axial, annular sheet gasket 18 which is flanged to the outer cylinder 3. The sheet gasket 18 is a rigid part resisting the water pressure and leaves open a small slot towards the inner cylinder 2. The sheet gasket 18 cooperates with an elastic lip seal 17, which has primarily a radial sealing effect.

The lip seal 17 is an end sealing strip detachably mounted on the horizontal side 26 of an annular winged flange 25 fastened to the projection 23. The lip seal 17 thereby turns with the cylinder 2. The lip seal 17 presses against an S-shaped bent chamber flange 22, which is fastened to the outer fixed cylinder 3. This way, between the two seals 17, 18, the projection 23 and the chamber flange 22 a flooding chamber 19 is created. The chamber flange 22 has a water connection 29 which is a connection through which fresh water can be brought from outside into the flooding chamber 19, the fresh water can reach the free inner space 21 through the slot leading towards the cylinder over the sheet gasket 18 and through this countercurrent can prevent rough dirt particles from reaching the lip seals.

As far as no sealing with respect to the countercurrent is intended, in the flooding chamber 19 minor quantities of washing liquid exiting over the sheet gasket 18 and the small slot can be captured and then discharged through the fixed connection piece 20.

In addition, behind the lip seal 17 through the chamber flange 22 a further collecting chamber can be formed, wherefrom the washing solution which might exit in the case of a failure of the lip seal 17, can be controlledly captured through a discharge 24.

The chamber flange 22 cooperates at its end with an annular girder or plate 28 which is welded into the shell of the metallic cylinder 2. On the girder 28 also the winged flange 25 and the annular flange 10 are screwed together, so that they do not need to have a close fit on the cylinder 2.

The sealing system comprising the sheet gasket 18, flooding chamber 19 and the lip seal 17 can also be arranged in the inner space between the two cylinders 2, 3 at the height of the partitions dividing the compartments. Thus, the free space is sealed, so that the washing solution can no longer pass from one compartment to the other. For this purpose the sheet gasket 18 is again flanged to the outer cylinder 3 leaving free a small slot towards the cylinder 2. In the case of simple sealing problems, where small amounts of escaped washing solution do not count, the use only of the gasket sheet 18 could suffice. However, when absolute sealing is required, the lip seal 17 is detachably fastened on the cylinder 2 at a distance from the sheet gasket 18, which preferably is done with the aid of a buckle-on sealing strip. The seals are easily accessible after parts of the outer cylinder 3 have been removed. Thereby, the lip seal 17 can press directly against the wall of the outer cylinder 3 or against an annular flange fastened thereto.

Figure 4:
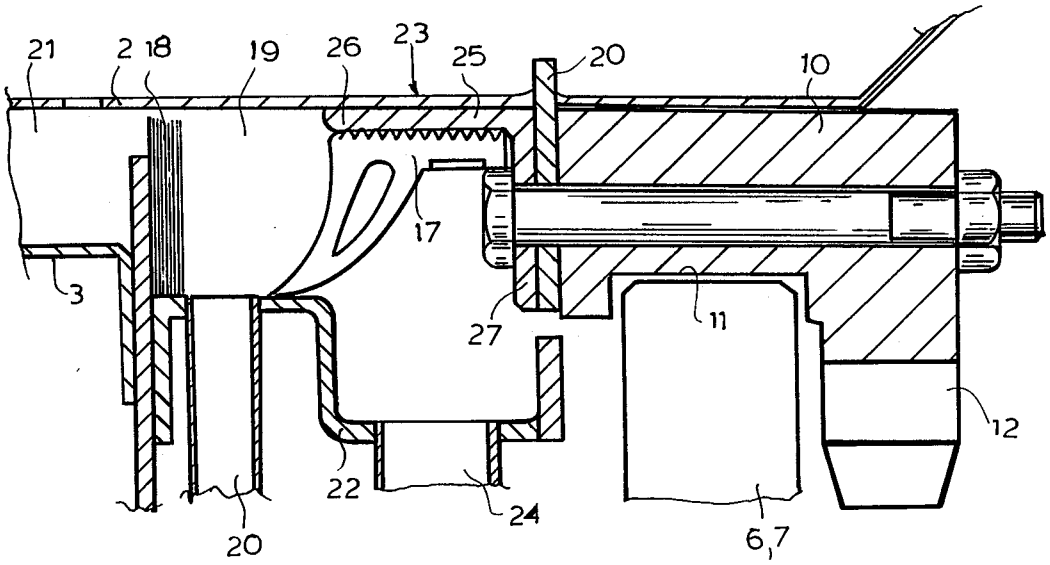
FIG. 4 is a detail cross section through a sealing system at the cylinder end.

The application of the lip seal 17 is preferably done radially, so that also in the embodiment example of FIG. 4, due to a possible liquid pressure ocurring in the flooding chamber 19, the lip seal 17 would have an additional pressure force as a result of its bent shape.

I claim:

1. A batch washing machine, comprising:

a base;

an outer elongated cylinder fixedly mounted on said base, said outer cylinder having a longitudinal axis and being formed with side walls at each end of said outer cylinder;

two flanges, each of said flanges being fastened to the respective side wall;

an inner elongated cylinder coaxial with and rotatable about said axis in said outer cylinder, said inner cylinder being formed with two projections defining respective ens of said inner cylinder, said projections axially extending over the respective side walls of the outer cylinder, said inner cylinder having a peripheral wall between the ends of said projections;

two annular flanges, each of said annular flanges being rigidly connected with the respective end of said inner cylinder and being formed with a sprocket at an end spaced from the respective flange fastened to the side walls of the outer cylinder;

guiding means for guiding said inner cylinder adjacent to the respective sprocket on the respective annular flange;

supporting means on said base for supporting said inner cylinder and cooperating with said guiding means;

sealing means for sealing free space between said inner and outer cylinders at each of said projections, said sealing means comprising:

a radial resilient lip seal urging against the peripheral wall and bearing upon the respective flange fastened to said side walls, and a sheet gasket flanged to the respective side wall of said outer cylinder and axially spaced from the respective radial resilient seal, said gasket being juxtaposed with said peripheral wall, so that said gasket and said resilient seal form an annular flooding chamber in a vicinity of respective projectionad, said annular flooding chamber being formed with means forming a water passage providing the chamber with a continuous water pressure preventing a water solution influxing said chamber.

2. The batch washing machine defined in claim 1 wherein said supporting means comprises at least two rollers, said rollers engage the respective longitudinal groove of each of said annular flanges.

3. The batch washing machine defined in claim 1 wherein said flanges fastened to the side walls are S-shaped flanges.

4. The batch washing machine defined in claim 3 wherein said S-shaped flange is formed with a discharging passage.

5. The batch washing machine defined in claim 1 wherein said guiding means comprise a peripheral groove at each of said annular flanges adjacent said sprockets.

6. The batch washing machine defined in claim 1 wherein said inner cylinder is formed with a plurality of compartments, said compartments are separated from one another.

7. The batch washing machine defined in claim 1 wherein said peripheral wall of said inner cylinder is perforated in a washing area, but said projections are not perforated.

8. The batch washing machine defined in claim 1 which comprises at least two motors on the base juxtaposed with the respective sprocket, said motors and said sprocket are coupled by an endless revolving chain.

9. A batch washing machine, comprising:

a base;

an outer elongated cylinder fixed on said base and subdivided to form compartments spaced along said outer cylinder for different washing liquids;

an inner elongated cylinder rotatable within said outer cylinder and formed with perforations over regions of said inner cylinder located in said compartments for allowing access of said liquids to laundry within said inner cylinder, said inner cylinder being provided with means for transferring laundry from compartment to compartment along said machine, said inner cylinder being open at one axial end to receive the laundry and at an opposite axial end to discharge the laundry;

sealing means between said cylinders at least at one end of said machine, said sealing means comprising:

a nonperforated axial extension of said inner cylinder projecting beyond said outer cylinder and having the same diameter as said inner cylinder, a sheet gasket seal on said outer cylinder extending toward said extension in a plane perpendicular to a common axis of said cylinders, and a lip seal between said cylinders in the region of said extension axially spaced from the sheet gasket seal; and drive means on said extension for rotating said inner cylinder relative to said outer cylinder.

* * * * *